United States Patent [19]

Danial

[11] 4,204,327

[45] May 27, 1980

[54] ELLIPSE COMPASS

[76] Inventor: Naguib F. Danial, 2503 W. Springfield Ave., Apt. E-3, Champaign, Ill. 61820

[21] Appl. No.: 6,182

[22] Filed: Jan. 24, 1979

[51] Int. Cl.[2] ..... B43L 11/04
[52] U.S. Cl. ..... 33/30 F
[58] Field of Search ..... 33/30 F

[56] References Cited

U.S. PATENT DOCUMENTS

| | | | |
|---|---|---|---|
| 233,424 | 10/1880 | McBean | 33/30 F |
| 1,139,298 | 5/1915 | Keppy | 33/30 F |

FOREIGN PATENT DOCUMENTS

| | | | |
|---|---|---|---|
| 99399 | 3/1925 | Fed. Rep. of Germany | 33/30 F |

OTHER PUBLICATIONS

"Popular Science" p. 175, Apr. 1945.

*Primary Examiner*—Charles E. Phillips
*Attorney, Agent, or Firm*—David V. Munnis

[57] ABSTRACT

Adjustable compass for drawing on a plane an ellipse of predetermined major and minor axes including a supported guide rod having a lower pointed end and a tracing bar attached to the guide rod through a connection which can rotate about and slide parallel to the axis of the guide rod, the tracing bar having a pointed marking element located on its lower end, the respective angles between the guide rod and the tracing bar and between the inclined guide rod and the plane of the ellipse being drawn adjustable to fixed positions so that, when the tracing bar is rotated about the guide rod while maintaining the marking element in contact with the surface on which the ellipse is being drawn, the marking element draws the desired ellipse.

1 Claim, 4 Drawing Figures

Fig. 2 : Sec. A-A

Fig. 3 : Sec. B-B

ELLIPSE COMPASS

BACKGROUND OF THE INVENTION

This invention relates to an adjustable compass for mechanically drawing varying ellipses of predetermined dimensions.

An ellipse is a geometric figure defined as a closed curve produced when a cone is cut, intermediate its apex and base, by a plane inclined obliquely to the cone's axis. Characteristic of such a figure is that it has perpendicularly intersecting chords of maximum and minimum lengths commonly known as the major axis and minor axis of the ellipse, respectively.

Numerous instances occur, such as in connection with the preparation of engineering and architectural drawings, wherein it is desired and necessary to depict ellipses figuratively and accurately. When a series of ellipses desired to be drawn are identical, a template drawing guide reflecting the dimensions of the common ellipse may be utilized. This approach, however, requires a series of templates for every conceivable ellipse, and thus is not feasible. The more commonly employed practice is to utilize a drafting guide referred to as a "french curve". This latter approach, however, while workable, is not totally acceptable in being time consuming, costly, and inherently not totally accurate. Hence, a search has long existed in the art for an inexpensive, versatile instrument adapted to rapidly and accurately draw varying ellipses.

OBJECTS OF THE PRESENT INVENTION

Accordingly, it is the primary object of the present invention to provide a versatile compass for mechanically drawing ellipses.

Another object of the present invention is to provide a variable compass for mechanically drawing ellipses which advantageously is simple in design and efficient in use.

An additional object of the present invention is to provide an inexpensive compass for mechanically drawing ellipses which advantageously easily can be adjusted to rapidly and accurately draw ellipses of varying dimensions.

The above and other objects are achieved and are features of the ellipse compass of the present invention which, broadly described, comprises:

(a) a guide rod having a lower end defining a point for location at the intersection of the major and minor axes of an ellipse to be drawn, (b) a tracing bar having a pointed marking element located at the lower end thereof, (c) connection means for pivotally attaching the upper end of said tracing bar adjacent said guide rod intermediate the ends of said guide rod, said tracing bar connection means being adapted to allow said tracing bar to be pivoted away from said guide rod to releaseably position said point of said marking element at a fixed distance from said point of said guide rod, measured in the drawing plane along the minor axis of the ellipse to be drawn, equal to the semi-minor axis of said ellipse, and said tracing bar connection means being adapted to allow said pivoted upper end of said tracing bar to rotate at a fixed distance about and slide parallel to the axis of said guide rod, and (d) means for supporting the upper end of said guide rod to releaseably fit the axis of said guide rod, in the plane intersecting the major axis of said ellipse and perpendicular to the drawing plane, at an angle to the drawing plane such that said point of said marking element may be positioned, in the drawing plane, at a distance from said point of said guide rod equal to the semi-major axis of said ellipse by rotation of said tracing bar about said guide rod.

BRIEF DESCRIPTION OF THE ATTACHED DRAWINGS

Having been broadly described, the ellipse compass of the present invention will be described below in greater detail with reference being made to the attached drawings, of which:

FIG. 2 is a sectional view of the tracing bar connection means of the compass embodiment shown in FIG. 1, taken at A—A;

FIG. 3 is a sectional view of a portion of the guide rod support means of the compass embodiment shown in FIG. 1, taken at B—B.

DESCRIPTION OF SPECIFIC EMBODIMENTS

Figure 1:
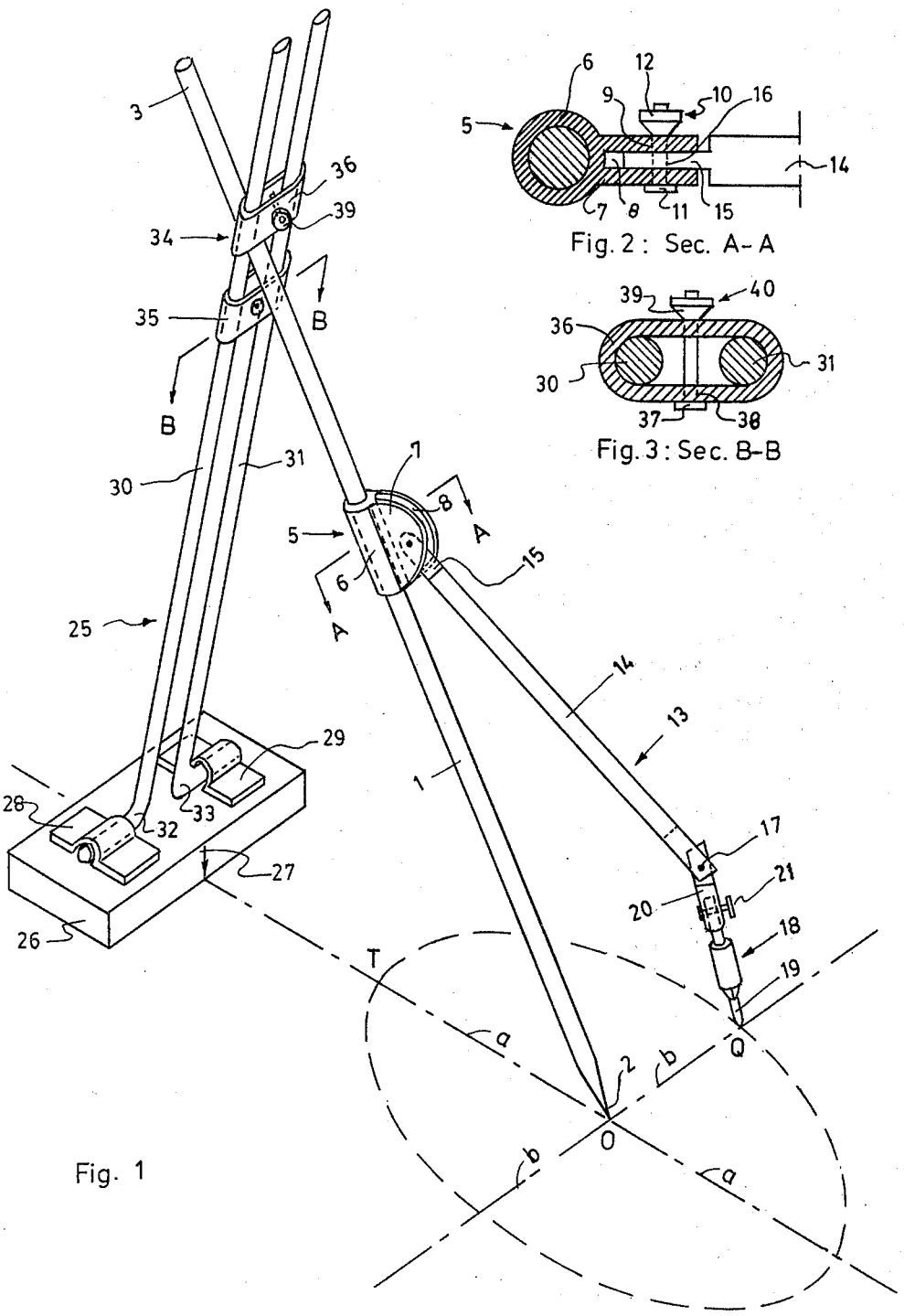
FIG. 1 is a perspective view of an embodiment of the ellipse compass of the present invention.

With reference to FIG. 1 numeral 1 designates a guide rod of the ellipse compass of the present invention having a pointed lower end 2 which is placed at point O, point O being the intersection of the major axis and minor axis of an ellipse to be drawn, said major and minor axes passing through lines TO and QO shown and having semi-major axis a and semi-minor axis b, respectively.

In accordance with the present invention the compass further includes a tracing bar assembly 13, as shown, including a main rod element 14 having, connected to its lower end at a movable but frictionally fixable pivot 17, a marking means 18 carrying at its lower end a pointed marking element 19, the latter of which can be adjusted as to vertical height by an intermediate telescopic connection at 20 that can be fixed in position by suitable locking means such as a set screw 21.

Tracing bar assembly 13 is mounted on guide rod 1 through a connection means 5 having a tubular base portion 6 through which guide rod 1 extends, with the relative dimensions between tubular portion 6 and guide rod 1 being such that connection means 5 is adapted for free slidable engagement along and free rotational movement about the axis of guide rod 1. In accordance with the present invention the upper end of tracing bar assembly 13 is pivotally attached to connection means 5 to allow the lower end of tracing bar assembly 13, bearing marking element 19, to be pivoted away from guide rod 1 to releasably position marking element point 19 at a fixed distance from point 2 of guide rod 1. Such releasable fixing of the upper end of tracing bar assembly 13 to connection means 5 suitably may be achieved by any conventional means involving an appropriate frictional contact, the use of available releasable fasteners and the like.

As shown, a preferred means for releasably fixing tracing bar assembly to connection means 5 by providing in connection means 5, integral with tubular element 6, a guide element 7 having a slot 8 therein perpendicular to the axis of guide rod 1. In tracing bar assembly 13 the upper end of main rod element 14 is partially reduced to form a tongue 15 which is adapted for insertion and slidable engagement within slot 8 of guide 7. Guide 7 and tongue 15 are provided with openings 9 and 16, respectively, which are adapted to be aligned with respect to each other to receive a releasable rod connection means 10 provided, as shown, in FIG. 2 by a cooperating threaded nut and bolt assembly 11, 12. It can be seen that, as shown, when nut 12 is in an appropriately released position, rod element 14 may be pivoted away from the axis of guide element 1, about the pivotal connection provided by bolt 11, with the axes of guide rod 1 and rod element 14 of assembly 13 being maintained in a common plane during such pivotal movement.

In accordance with the present invention, a support means 25 is provided for supporting the upper end 3 of guide rod 1, with support means 25 being adapted to releasably fix the axis of guide rod 1 in the plane intersecting the semi-major axis a of the ellipse to be drawn and perpendicular to the drawing plane, the drawing plane being the plane containing lines TO and QO and to adapt guide rod 1 for pivotal movement about point O in said plane perpendicular to the drawing plane. Such releasable fixing of the upper end 3 of guide rod 1 by support means 25, as in the case of the connection between tracing bar assembly 13 and connection means 5 suitably may be achieved by any conventional means including an appropriate frictional engagement therebetween, by the use of available releasable fastening elements and the like.

In a prefered embodiment of the compass of the present invention, support means 25 is provided by a pair of identical rod elements 30 and 31 being mounted, for parallel rotational movement, about bends in their feet 32 and 33 within brackets 28 and 29, respectively, fixed on support base element 26. Rods 30 and 31 are positioned in a spaced relationship to allow the upper end 3 of guide rod 1 to pass therebetween. A pair of band elements 35 and 36 are positioned around and adapted for slidable engagement along rods 30 and 31 and further are spaced apart to allow the upper end 3 of guide rod 1 to extend therebetween. Each band element 35 and 36 is adapted with a suitable locking means 40, such as provided by cooperating threaded bolt and nut assembly 37, 39, shown in FIG. 3, to allow bands 35 and 36 to be releasably fixed in position to adjust guide rod 1 at the desired angle from the drawing of plane.

To utilize the ellipse compass, shown in FIGS. 1–3, in drawing an ellipse with a and b as major and minor semi-axes, respectively, the rectangular axes of the ellipse are first drawn mechanically on the drawing surface to intersect at point O. Points T and Q are then plotted and drawn so that line TO equals a and line QO equals b. Base 26 of support means 25 is then positioned so that center line mark 27 of base 26 lies on the ellipse's major axis at a distance away from points O and T, and the lower point 2 of guide rod 1 is placed at point O. Tracing bar assembly 13 is pivoted away from guide rod 1 about bolt pivot 11 in the direction of the minor axis to position the lower end 19 of marking element 18 at a distance b from point O, and fasteners 10 and 21 are tightened to fix rod 14 and marking element 18 in this location. Tracing bar rod 14 is then rotated around guide rod 1 to bring it in the direction of the major axis, and while doing so, point 19 of marking element 18 is elevated slightly above the drawing plane to avoid making any drawings. Fasteners 40 of both belt elements 35 and 36 are loosened and belts 35 and 36 are appropriately slid upwardly or downwardly along rods 30 and 31, thereby guiding the upper end 3 of guide rod 1 with them to allow guide rod 1 to be tilted vertically until point 19 of marking element 18 reaches point T and, thus, at a distance a from center point O. Fasteners 40 of belts 35 and 36 are then tightened to maintain and fix guide rod 1 in this position. The desired ellipse is then drawn by marking element 18 when tracing bar assembly 13 is rotated 360° about guide rod 1.

In instances wherein the angle between tracing bar element 14 and guide rod 1 is greater than the inclination of guide rod 1 relative to the drawing plane, it is not possible to draw the entire ellipse with support base 26 in one position. In such cases, the unfinished part of the ellipse can be completed by transferring support 26 to the opposite side of the partially drawn ellipse, along the major axis, repeating the described adjustment of the compass, and then rotating the tracing bar assembly 13 to draw the uncompleted part of the ellipse.

By means of the compass of the present invention, ellipses of varying sizes advantageously rapidly and accurately may be drawn by a single adjustable versatile device.

Principle

Figure 4:
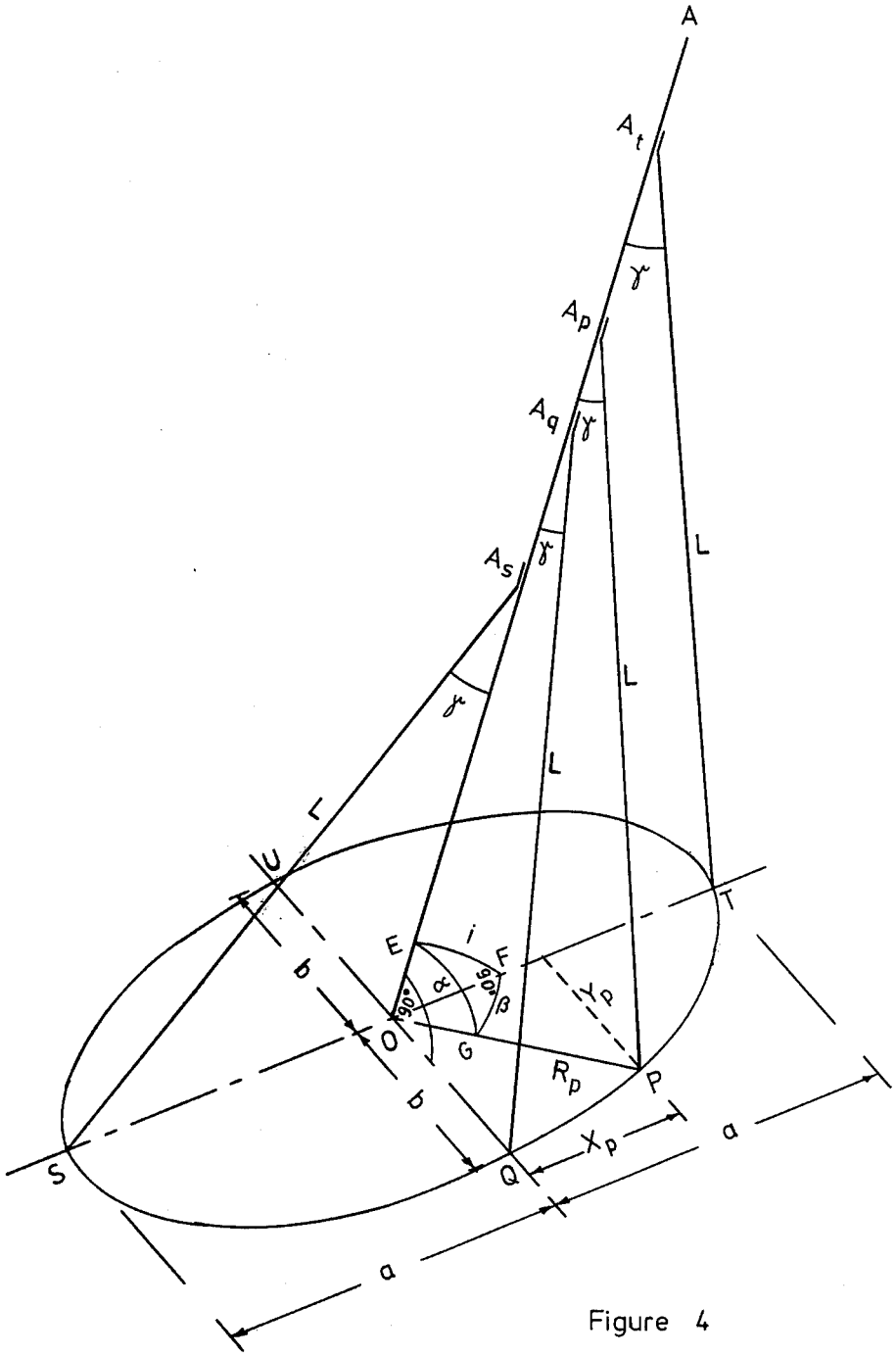
FIG. 4 shows the geometry of an ellipse drawn using the compass of the present invention.

FIG. 4 illustrates an inclined line AO in a vertical plane AOT making an angle AOT=i with the horizontal plane of paper SUTQ. A line of constant length L is connected to AO at a fixed angle $\gamma$ in such a way that its upper point can rotate around and slide along AO frictionless and its lowest point rests on a horizontal plane. One imagines that this line rotates clockwise starting from its initial position $A_tT$. It will leave the vertical plane $A_tOT$ while point $A_t$ will slide down along AO until it reaches its lowest elevation at point $A_s$. At this position the rotating line is again in the same initial vertical plane but at the location $A_sS$. Further rotation will cause the upper point of the rotating line to rise and to return back to its initial position at point $A_t$. The lower point of the rotating line will describe a closed curve on the horizontal plane. It will be proven in the following that this closed curve is an ellipse.

Mathematical proof

At any moment, the rotating line is in a plane together with the stationary inclined line AO. This plane is of course rotating and will intersect the horizontal plane of paper in radial lines R. These radial lines make the horizontal angles $\beta$ with the initial direction OT and make also the inclined angles $\alpha$ with the fixed line AO. The relationship between the angles i, $\beta$, and $\alpha$ can be easily obtained by applying the cosine law to the spherical triangle EFG shown in FIG. 4.

$$\cos\alpha = \cos i \cdot \cos\beta + \sin i \cdot \sin\beta \cdot \cos GFE \qquad (1a)$$

The spherical angle $G\hat{F}E$ is a right angle since it is included between the vertical plane $A_tOT$ and the horizontal plane TOP. Therefore equation (1*a*) reduces to $$\cos\alpha = \cos i \cdot \cos\beta \qquad (1b)$$

By solving the rotating triangle at particular positions, the following radial distances are obtained:

$$\Delta\, A_tOT \text{ (vertical) } OT = \frac{L \cdot \sin\gamma}{\sin i} = a \qquad (2)$$

-continued $$\Delta A_pOP \text{ (inclined) } OP = \frac{L \cdot \sin\gamma}{\sin\alpha} = R_p \quad (3)$$

$$\Delta A_qOQ \text{ (inclined) } OQ = \frac{L \cdot \sin\gamma}{\sin 90} = b \quad (4)$$

$$\Delta A_sOS \text{ (vertical) } OS = \frac{L \cdot \sin\gamma}{\sin(180 - i)} = a \quad (5)$$

Combining equations (2) and (4) together leads to $$a = b/\sin i \quad (6)$$

Similarly from equations (3) and (4) one gets $$R_p = b/\sin\alpha \quad (7)$$

One considers a rectangular coordinate system with origin at O, the X-axis in the direction OT, and the Y-axis in the direction OQ. The coordinates of the lower point of the rotating line at the moment when it is at point P will therefore be $$X_p = R_p \cdot \cos\beta \quad (8a)$$

$$Y_p = R_p \cdot \sin\beta \quad (8b)$$

Substituting equations (1*b*) and (7) into equations (8*a*) and (8*b*) results in $$X_p = \frac{b}{\sin\alpha} \cdot \frac{\cos\alpha}{\cos i} \quad (9a)$$

$$Y_p = \frac{b}{\sin\alpha} \cdot \sqrt{1 - \frac{\cos^2\alpha}{\cos^2 i}} \quad (9b)$$

Dividing equations (9*a*) by a as given in equation (6), and dividing equation (9*b*) by b, then squaring both quantities leads to $$\left(\frac{X_p}{a}\right)^2 = \left(\frac{b}{\sin\alpha} \cdot \frac{\cos\alpha}{\cos i} \cdot \frac{\sin i}{b}\right)^2 = \frac{\sin^2 i \cdot \cos^2\alpha}{\cos^2 i \cdot \sin^2\alpha} \quad (10a)$$

$$\left(\frac{Y_p}{b}\right)^2 = \left(\frac{b}{\sin\alpha}\right)^2\left(1 - \frac{\cos^2\alpha}{\cos^2 i}\right) \cdot \frac{1}{b^2} = \frac{\cos^2 i - \cos^2\alpha}{\cos^2 i \cdot \sin^2\alpha} \quad (10b)$$

Adding equations (10*a*) and (10*b*) gives $$\left(\frac{X_p}{a}\right)^2 + \left(\frac{Y_p}{b}\right)^2 = \frac{\sin^2 i \cdot \cos^2\alpha + \cos^2 i - \cos^2\alpha}{\cos^2 i \cdot \sin^2\alpha}$$

$$= \frac{\cos^2\alpha\,(\sin^2 i - 1) + \cos^2 i}{\cos^2 i \cdot \sin^2\alpha}$$

$$= \frac{\cos^2\alpha\,(-\cos^2 i) + \cos^2 i}{\cos^2 i \cdot \sin^2\alpha}$$

$$= \frac{\cos^2 i\,(1 - \cos^2\alpha)}{\cos^2 i \cdot \sin^2\alpha}$$

-continued $$= \frac{\cos^2 i \cdot \sin^2\alpha}{\cos^2 i \cdot \sin^2\alpha}$$

$$= 1$$

The equation of the ellipse is satisfied.

It should be noted here that if AO is kept vertically, the lower point of the rotating line will draw a circle with a radius r=b. Also the plane of the drawing does not necessarily need to be horizontal. The only condition is that the plane containing the major axis and the line AO must be perpendicular to the plane of the drawing.

What is claimed is:

1. A compass for mechanically drawing an ellipse of predetermined major and minor axes comprising:

(a) a guide rod having a lower end defining a point for location at the intersection of the major and minor axes of an ellipse to be drawn, (b) a tracing bar having a pointed marking element located at the lower end thereof, (c) connection means for pivotally attaching the upper end of said tracing bar adjacent said guide rod intermediate the ends of said guide rod, said tracing bar connection means being adapted to allow said tracing bar to be pivoted away from said guide rod to releaseably position said point of said marking element at a fixed distance from said point of said guide rod, measured in the drawing plane along the minor axis of the ellipse to be drawn, equal to the semi-minor axis of said ellipse, and said tracing bar connection means being adapted to allow said pivoted upper end of said tracing bar to rotate at a fixed distance about and slide parallel to the axis of said guide rod, and (d) means for supporting the upper end of said guide rod to releaseably fix the axis of said guide rod, in the plane intersecting the major axis of said ellipse and perpendicular to the drawing plane, at an angle to the drawing plane such that said point of said marking element may be positioned, in the drawing plane, at a distance from said point of said guide rod equal to the semi-major axis of said ellipse by rotation of said tracing bar about said guide rod, said support means for said upper end of said guide rod comprising a pair of parallel rod elements, apaced apart to receive therebetween said upper end of said guide rod, said rod elements being mounted, for parallel rotational movement, about bends in the feet thereof which feet are positioned within brackets fixed on a base support, said rod pair having positioned thereon a pair of band elements, laterally spaced apart to receive therebetween said upper end of said guide rod said pair of band elements being mounted around and adapted for slideable engagement along said rod pair, each of said band elements having a locking means to allow said band elements to be releaseably fixed in position along said rod pair to adjust said guide rod at the desired angle to the drawing plane.

* * * * *